US005168120A

United States Patent [19]

Rossel

[11] Patent Number: 5,168,120

[45] Date of Patent: Dec. 1, 1992

[54] RECOIL SYSTEMS

[75] Inventor: Ulf Rossel, Granbergsdal, Sweden

[73] Assignee: AB Bofors, Sweden

[21] Appl. No.: 639,874

[22] Filed: Jan. 11, 1991

[51] Int. Cl.[5] ..... F41A 25/02

[52] U.S. Cl. ..... 89/43.01; 89/198

[58] Field of Search ..... 89/43.01, 198, 42.01, 89/43.02, 177

[56] References Cited

U.S. PATENT DOCUMENTS

| | | | |
|---|---|---|---|
| 461,347 | 10/1891 | Krone | 89/43.01 |
| 2,410,116 | 10/1946 | Vickers | 89/43.01 |
| 2,718,390 | 9/1955 | Taylor | 89/43.01 |
| 3,964,365 | 6/1976 | Zielinski | 89/43.01 |
| 3,991,650 | 11/1976 | Garland et al. | 89/43.01 |
| 4,296,670 | 10/1981 | Northup et al. | 89/43.01 |
| 4,587,882 | 5/1986 | Metz | 89/43.01 |
| 4,995,281 | 9/1990 | Metz et al. | 89/43.01 |

FOREIGN PATENT DOCUMENTS

| | | | |
|---|---|---|---|
| 0194994 | 8/1988 | European Pat. Off. . | |
| 3015126 | 9/1983 | Fed. Rep. of Germany | 89/43.01 |

*Primary Examiner*—Stephen M. Johnson

*Attorney, Agent, or Firm*—Pollock, Vande Sande & Priddy

[57] ABSTRACT

A device is employed in a recoil system for large-caliber ordnance, to effectuate damping of the recoil system during its rearward movement with simultaneous storage of energy obtained from the recoil kinetic energy of the recoil system. The device then supplies thus stored energy, to the recoil system on its recuperative movement which follows the recoil movement. The device may also supply energy to other energy consumers disposed on or in the proximity of the gun. The device may also receive additional energy in the event of energy supply shortage.

6 Claims, 2 Drawing Sheets

RECOIL SYSTEMS

TECHNICAL FIELD

The present invention relates to a device in recoil systems for large-caliber ordnance.

BACKGROUND OF THE INVENTION

In large-caliber ordnance, the recoil system must be arrested on firing of the weapon, when the system recoils. The system must thereafter be recuperated to a starting position. These functions are well known in the gunnery art and are provided for in different ways on the gun.

SUMMARY OF THE INVENTION

In the ongoing progressive development of ordnance, there has been a need that for the gun and its component parts to be designed in a technically simple manner and yet with smoothly operating and few parts/components. Damping and recuperating of the recoil system in a gun have hitherto been designed in relatively complex manners. Moreover, at low rates of fire (low ramming speed), that is a long laying time, there is always excess energy $$\left(w = \frac{m \times v^2}{2}\right),$$

while, conversely, at very high rates of fire there is insufficient energy for laying. In the latter case, external energy must be supplied. Hence, the above situation entails that there may be requirements for an energy equilibrium function.

The primary object of the present invention is to propose a device which obviates the above problems and provides capability, in one single unit, of effectuating damping of the recoil system and at the same time as the unit participates in the recuperation function of the recoil system.

The novel device according to the present invention therefore includes a unit which effectuates damping of the recoil system during its reverse movement while simultaneously storing energy derived from the recoil kinetic energy of the recoil system; and that the unit is operative, to supply the stored energy to the recoil system on its recuperative movement which follows the recoil movement.

In cases of high recoil impetus, high energy and low mass, the recoil system may be tapped of accumulated (hydraulic) energy for other energy users located on the weapon or in the vicinity thereof, for example loaders, lifting hoists for ammunition handling, and the like. Any surplus energy which occurs between recoil and recuperation may thus be employed for other purposes within the ordnance system, for example limbering of field gun carriages and, by selection of suitable pre-charges, firing of the gun using different charges.

According to one embodiment of the present invention, the unit comprises a forward cylinder and an accumulator cylinder connected thereto. In such instance, the forward cylinder encloses a recoil piston which, through a recoil piston rod, is connected to the recoil system. The recoil piston is provided with an integrated recuperation piston and, ahead of this piston, a floating recuperation accelerator piston. This latter includes a central recess in which the recuperation piston is longitudinally displaceable. On actuation of the recoil piston from the recoil system, in the recoiling movement, working medium ahead of the recoil piston is compressed and acts on the recuperation accelerator piston which, in turn, forces working medium into the accumulator cylinder for storing energy in the accumulator cylinder. The unit further comprises one or more shunt channels which lead working medium past the recuperation accelerator piston when the recoil piston compresses the working medium. Each respective channel includes a spring-biased one-way valve, through which the working medium passes into the accumulator cylinder for storage of energy in the accumulator cylinder.

The acceleration recuperation piston participates in the recuperation function of the recoil system, the piston being, in this position, actuated by the energy stored in the accumulator. The integrated recuperation piston also participates in the recuperation function and, when the acceleration piston has reached its end position, the integrated piston effects a constant velocity in the recoil system until this is arrested. Working medium is replenished in a space behind the recoil piston on its recoil movement. This replenishment takes place through a non-return valve which is open when the piston moves because of the retractory movement in the recoil system, and is closed during the recuperation movement of the piston. The unit comprises, or cooperates with or is connected to, a second valve through which working medium is replenished in the event of shortage thereof when the recoil piston executes its recuperation movement.

The novel features as set forth above provide an extremely simple design of the unit exercising the damping and recuperation operations, from which unit energy may, moreover, be tapped for other users. Hence, the unit includes cylinders, pistons and nonreturn valves and handles, stores and uses the recoil energy of a gun with the aid of these components and working medium employed, for instance hydraulic fluid, compressed air and the like.

BRIEF DESCRIPTION OF THE ACCOMPANYING DRAWINGS

The nature of the present invention and its aspects will be more readily understood from the following brief description of the accompanying Drawings, and discussion relating thereto.

In the accompanying Drawings:

FIGS. 1–3 show both the basic connection of the unit to the recoil system in a gun, and other functional stages which show among others how the unit, during simultaneous damping of the recoil system, stores the recoil energy of the gun on the recuperatory movement of the system, and utilizes this energy for the recuperation function and for supplying other users; and FIG. 4 is a longitudinal cross-section showing one embodiment of the unit according to the present invention.

DESCRIPTION OF PREFERRED EMBODIMENT

Figure 1:
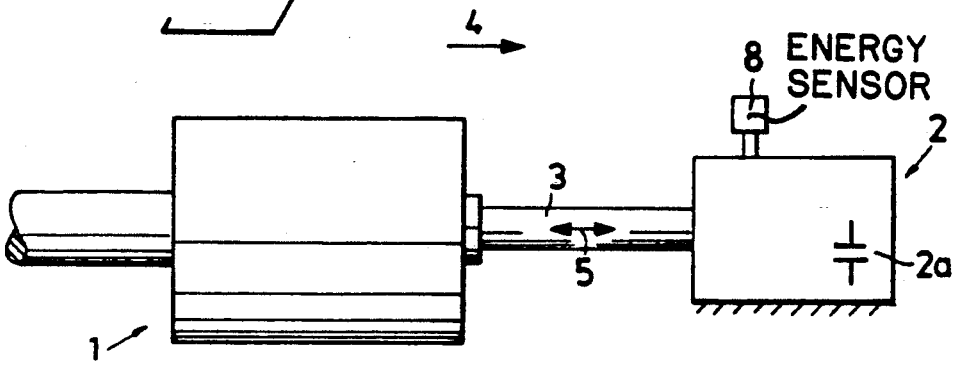
Figure 2:
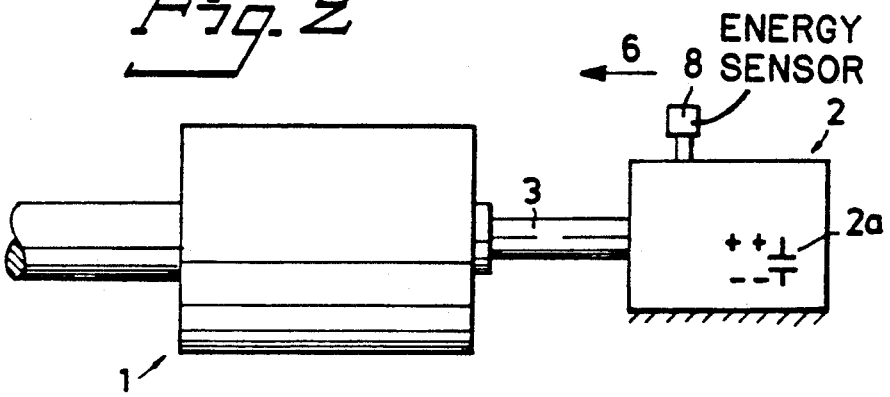
Figure 3:
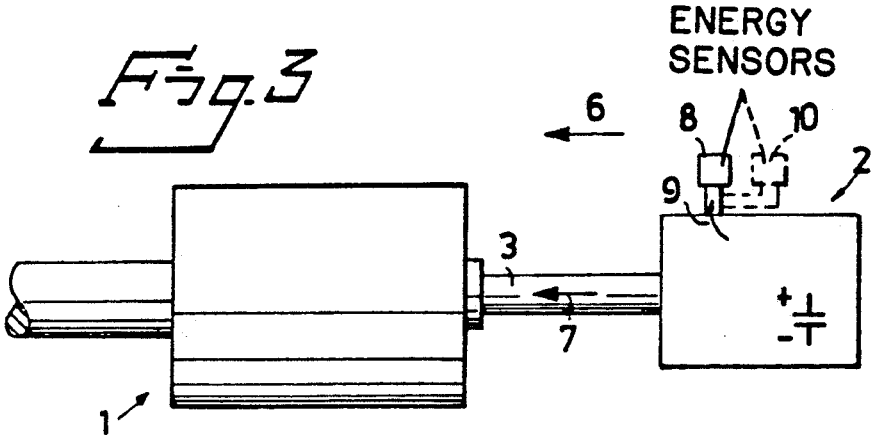

Referring to the Drawings, the recoil system is indicated by reference numeral 1 in FIGS. 1–3. A unit 2 according to the invention is connected to the recoil system through a piston rod or ram 3. Anchorage of the piston rod in the recoil system may be effected at a suitable position and in a known manner. FIG. 1 illustrates the case in which the recoil system, in connection with the gun discharging a round, begins to move rearwardly in the direction of the arrow 4. A storage function is symbolized by reference numeral 2*a*. The force or energy which the recoil system 1 now begins to transmit to the unit, is indicated by reference numeral 5 and will, hereinafter, be referred to as a recoil energy. In FIG. 2, the recoil system has reached its rearmost end position, entailing that energy has been stored in the energy storage function 2*a* of the unit 2. In this position, the unit 2 begins to exercise its recuperation function on the recoil system in the direction of movement shown by reference numeral 6. FIG. 3 shows an intermediate position at which the recoil system has advanced a distance towards its fully recuperated starting position in the weapon. In this phase, it is shown how the stored energy may be employed partly for supplying power to the recoil system in its recuperative function, see arrow 7, and partly for supplying a unit 8 connected to the unit 2 and representing another function or unit within the weapon than the recuperation function/the recoil system, for instance a hoist for ammunition handling. The power/energy supply arrow is indicated by reference numeral 9. In one embodiment, a plurality of users may be supplied, and, in FIG. 3, an additional user designated 10 has been shown by broken lines.

Figure 4:
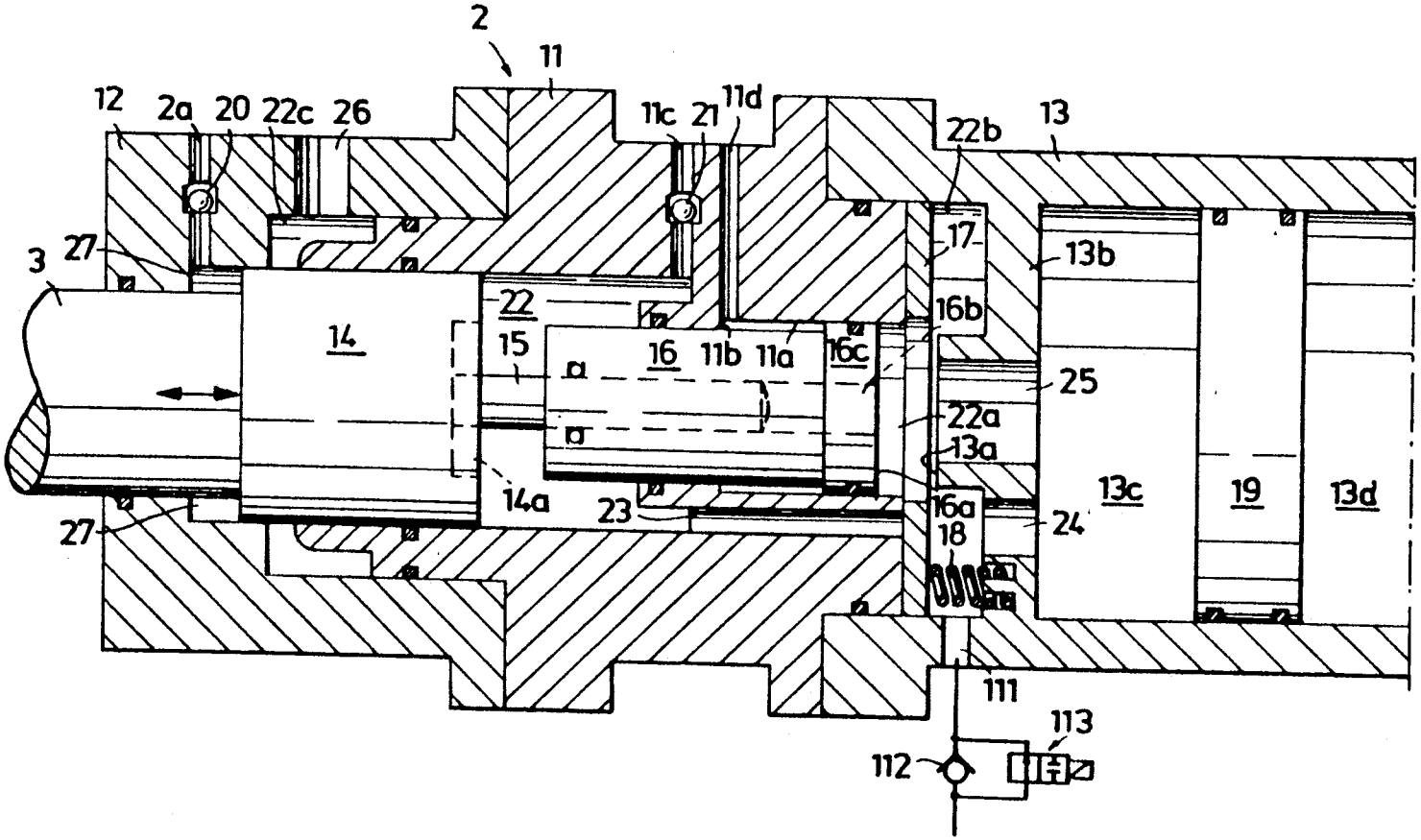

The unit according to FIG. 4 is based on the following fixed parts: a cylinder 11, front end wall 12, rear end wall with accumulator a cylinder 13. The unit also comprises the following moving parts, a recoil piston rod with recoil piston 14, and integrated recuperation piston 15, recuperation acceleration piston 16, non-return valve means 17 with one or more return springs 18, floating piston 19 in the pressure accumulator and two non-return valves 20 and 21. In the figure, the recoil piston rod has been given the same reference numeral 3 as in FIGS. 1–4.

In FIG. 4, the unit assumes a position where the recoil piston 14 of the recoil system is actuated inwardly through the piston rod 3 (to the right in FIG. 4) in relation to the fixed parts. A working medium, for instance hydraulic fluid or other medium is, in this instance, compressed in a space 22 ahead of the piston 14. The pressure elevation in the space 22 entails that the piston 16 is actuated towards its outer position (to the right in FIG. 4) which is determined by co-operation between an end surface 16*a* and an inner arrest surface 13*a* on an inner wall 13*b* in the unit. When the piston 16 reaches its end position, the pistons 14, 15 may move in relation to the piston 16 in that the piston 15 is journalled and longitudinally displaceable in a central recess 16*b* in the piston 16. The piston 15 is pin-shaped and is secured to the piston 14 at its center so that the longitudinal axes of the pistons 14 and 15 coincide. At the center, the piston 14 is provided with a central recess 14*a* in which the piston 16 may be partly inserted in the outer end position so that end position damping is achieved.

The unit is also fitted with one or more inner channels 23 disposed in the cylinder 11 so that they shunt working medium past the piston 16 during the compression movement. The non-return valve means 17 is actuated to its open position against the action of the return spring 18 on this compression. Working medium in the space 22*a* ahead of the pistons 14, 15 and 16 may, as a result of the illustrated arrangement, flows through recesses 24 and 25 in the wall 13*b* to the liquid space 13*c* of the accumulator cylinder. The piston 16 has a forward flared portion 16*c* which is journalled in an inner wall surface 11*a* on the fixed cylinder 11. At the outer end position of the piston 16 an annular space 22*b* is defined, in which the non-return valve means 17 operates, by the piston 16, apart from at a small circular gap between the center aperture of the disk-shaped non-return valve means and the flared portion 16*c*. The space behind the portion 16*c* is connected to an external tank or reservoir via a channel 11*d*.

The liquid is compressed in the space 13*c* of the accumulator, with the result that the floating piston 19 of the accumulator is displaced towards the gas space 13*d* of the accumulator and causes compression of the gas in the pressure accumulator 13.

The unit is connected to an external tank or reservoir (the unit according to FIGS. 1–3), which is connected through connections 2*a*, 26, 11*c*, 11*d*. The non-return valve 20 is disposed in the L. connection 2*a*. Like the connection 26, this connection 2*a* is connected to the external hydraulic system. When the piston 14 moves to the right in the figure, the non-return valve 20 opens the communication 2*a* and working medium for the exterior system may flow in through channel 2*a* and, once an annular recess 22*c* has been exposed by the recoil piston 14, also through connection 26. When the piston 14 moves from an outer end position (the position to the right in FIG. 4) the non-return valve 20 closes, such that efficient and gentle braking is achieved by a medium (hydraulic fluid) enclosed in a space 27.

When the pistons 14, 15 and 16 assume their outer positions at which the energy stored in the accumulator is at its highest, the recoil system will have been arrested by the unit and reached its rearmost position. The unit thereafter begins to effectuate energy transmission to the recuperation function of the system. The stored energy in the accumulator actuates the recuperation piston 15 and the acceleration recuperation piston 16, of which accelerates the forwardly recuperating recoil system. In such instance, the non-return valve means 17 is closed. When the piston 16 reaches its innermost position as determined by the co-operation between an inner space 11*b* and the flared portion 16*c* of the piston 16, the piston 15 alone takes over the recuperation function and supplies energy at constant speed until such time as the piston 14 is braked in brake grooves. Any possible shortage of liquid in the space 22 will be compensated for through the non-return valve 21 which is closed when the piston 14 moves to the right in the figure and compresses the working medium in the space 22, and opens when the piston moves to the left in FIG. 4 and causes reduced pressure in the space 22. Replenishment of liquid takes place from an external tank or reservoir through a channel 11*c* in which the nonreturn valve 21 is disposed.

Secondary devices or systems may be supplied by a channel or channels 111. The medium tapped in this instance is recycled to the exterior tank or reservoir for re-use. In the event of energy requirements, energy may, on the other hand, be supplied through the channel or channels 111. Tapping in connection with the supply of secondary systems takes place through a non-return valve 112. Replenishment for energy supply is effected by means of an operating valve 113 which, in one position as shown in FIG. 4, shunts the non-return valve, and in a second position activates the non-return valve. The operating valve receives electric control signals in response to whether energy supply or energy tapping, respectively, is to take place. According to the present invention, it is also proposed that the mass (m)

should be kept low in relevant parts, which may be effected by employing composite materials.

Thus, the present invention allows to achieve a unique advantage in that between, during, before and after each round or salvo, the pressure levels in the spaces 13*c*, 13*d* and 22 may, from an external pump or external tapping, be regulated through the channels 111 and 11*c*. Moreover, the charging volume/charging pressure of the pressure accumulator may also be regulated.

Different types of working medium may be employed such as gas, for example air, freon, argon and liquid for example water, glycol, oil, silicon and suitable mixtures thereof.

The fixed parts 11, 12 and 13 are united and mutually sealed in a known manner. Similarly, the pistons and the piston rod 3 are sealed by sealing means of known types and in known manners.

The tank or reservoir which is connected to the channels 2*a*, 26, 11*c* and 11*d* consists of a tank with atmospheric aeration.

The present invention should not be considered as restricted to that described in the foregoing and shown on the drawings, many modifications being conceivable without departing from the spirit and scope of the appended claims.

What we claim and desire to secure by Letters Patent is:

1. A device for a recoil system of a weapon comprising:

means for effecting damping of the recoil system during a rearward, recoil movement thereof while simultaneously storing energy obtained from the recoil kinetic energy of the recoil system and for supplying the stored energy to the recoil system during a forward, recuperative movement which follows the recoil movement, said means including:

1) a housing defining a first space and a second space for working medium and means for communicating said first space with said second space;

2) a recoil piston, connected to the housing during its entire movement through a recoil piston rod and moveable in said first space and a recuperation piston secured to said recoil piston;

3) a floating recuperation acceleration piston located in said first space ahead of said recoil piston as seen in the direction of the rearward movement of said recoil piston;

4) said recuperation piston being longitudinally moveable in a recess extending through said floating recuperation acceleration piston;

5) said floating recuperation acceleration piston being moveable in said rearward direction by said working medium compressed by said recoil piston during said recoil movements for forcing said compressed working medium into said second space and for storing energy in said second space during said recoil movement;

6) said floating recuperation acceleration piston being also moveable during the recuperative movement of the recoil system in a direction opposite to said rearward direction by the energy stored in said second space, said floating recuperation acceleration piston being moveable in said opposite direction to a predetermined restricted position, whereupon further movement of said recoil piston is effected by movement of said recuperation piston connected to said recoil piston.

2. A device according to claim 1 further comprising a first projecting member positioned on said floating recuperation acceleration piston and a second member provided in said first space and cooperating with said first member for maintaining said floating recuperation acceleration piston in said restricted position.

3. A device according to claim 1 further comprising flow communicating means extending through the walls of said housing to communicate said first space with outside energy users for transmitting excess of said stored energy to said outside energy users.

4. The device as claimed in claim 1 further comprising at least one lead-off and supply channel respectively, extending through said housing, and provided with a non-return valve for leading off said working medium on surplus energy generated by the device and for supplying energy thereto on the occurrence of a shortage of energy in the device.

5. The device as claimed in claim 1, wherein said working medium is replenished in said first space ahead of said recoil piston by another non-return valve which is closed during the recoil movement of the recoil piston and open during the recuperative movement.

6. The device as claimed in claim 1, wherein said recuperation piston is integral with said recoil piston.

* * * * *